US005381744A

United States Patent [19]

Kamewada et al.

[11] Patent Number: 5,381,744

[45] Date of Patent: Jan. 17, 1995

[54] STITCH BALANCING THREAD TENSION DEVICE FOR SEWING MACHINE

[75] Inventors: Makoto Kamewada; Shinji Kojima, both of Tochigi, Japan

[73] Assignee: The Singer Company N.V., Curacao, Netherlands

[21] Appl. No.: 57,927

[22] Filed: May 7, 1993

[30] Foreign Application Priority Data

Nov. 18, 1992 [JP] Japan ..... 4-85268[U]

[51] Int. Cl.[6] ..... D05B 47/02

[52] U.S. Cl. ..... 112/254

[58] Field of Search ..... 112/254, 255, 59, 97; 242/147 R, 149, 150 R

[56] References Cited

U.S. PATENT DOCUMENTS 4,111,141 9/1978 Thomson ..... 112/254
4,466,371 8/1984 Larsen ..... 112/254 X
5,191,847 3/1993 Kojima et al. ..... 112/254
5,211,122 5/1993 Lin ..... 112/254

*Primary Examiner*—Peter Nerbun

[57] ABSTRACT

A stitch balancing thread tension device for a sewing machine, the body of which is inserted into the opening portion of the sewing machine body, wherein the thread tension device body for supporting a stem on which a pair of tension discs are fit, comprises a projecting portion which contacts the outer side surface of the sewing machine body and pawls which are retained at the circumferential edge of the opening portion by the inner side surface of the sewing machine body for clamping the sewing machine body therebetween. The pawls are elastically invaginable into the thread tension device body to release the sewing machine body from clamping. Since the thread tension device can be attached to or detached from the sewing machine body in one-shot operation, the operability is remarkably improved in efficiency.

1 Claim, 2 Drawing Sheets

STITCH BALANCING THREAD TENSION DEVICE FOR SEWING MACHINE

BACKGROUND OF THE INVENTION

1. Field of the Invention

The present invention relates to a a stitch balancing thread tension device for a sewing machine.

2. Description of the Related Art

As a conventional stitch balancing thread tension device (referred to as a thread tension device hereinafter) for a sewing machine, there is known a thread tension device which is attached to a sewing machine body 58 composed of the casing or front cover thereof as illustrated in FIG. 5. The thread tension device 50 is attached to the sewing machine body according to the following process. That is, a stem 51 of the thread tension device body is inserted into the opening portion 58*a* of the sewing machine body 58 until an annular projecting portion 52 is brought into contact with the outer side surface 58*b* of the sewing machine body 58, and a nut 55 is screwed thereon after setting a washer 53 and a spring washer 54 onto the externally threaded stem 51.

In this way the thread tension device 50 is attached to the sewing machine body 58 as the latter is clamped between the annular projecting portion 52 and the nut 55. The thus attached thread tension device 50 elastically clamps a needle thread, not shown, between a pair of thread tension discs 56*a* and 56*b* for applying a given tension thereto. A projection 52*a* formed on the projecting portion 52 engages a retaining hole 58*d* on the sewing machine body 58 for preventing the stem 51 from turning. A regulating dial 57 comprises a tension spring, not shown, therein for bringing the pair of tension discs 56*a* and 56*b* into elastic contact with each other.

Such a conventional thread tension device 50, however, had a technical problem created by troublesome operations in attaching the device to the machine body and in detaching the device from the machine body.

SUMMARY OF THE INVENTION

The present invention has been made in view of such a conventional technical problem to provide a thread tension device for a sewing machine the body of which is inserted into the opening portion of the sewing machine body, wherein a thread tension device body for supporting a stem on which a pair of tension discs are fit comprises a projecting portion which contacts the outer side surface of the sewing machine body and pawls which are retained at the circumferential edge of the opening portion by the inner side surface of the sewing machine body and are elastically invaginable into the thread tension device body.

The projections of the thread tension device body can engage the grooves of the sewing machine body so that the thread tension device body is unturnable relative to the sewing machine body.

The operation of attaching the thread tension device to the sewing machine body is performed as follows. That is, the thread tension device is held with hand and the body thereof is inserted into the opening portion of the sewing machine body from the side of the outer side surface thereof. When the thread tension device body is pushed in the opening portion, the pawls are elastically invaginated, and when the projecting portion thereof contacts the outer side surface of the sewing machine body, the pawls elastically rebound as they are released from the restriction of the opening portion.

As a result, the thread tension device body is fixedly attached to the sewing machine body as the same is clamped between the projecting portion of the thread tension device body which contacts the outer side surface of the sewing machine body and the pawls thereof which are retained by the inner side surface of the sewing machine body. At that time, the projections of the thread tension device body engage the concave portions of the sewing machine body so that the thread tension device body is attached to the sewing machine body so as to be properly positioned in the circumferential direction and unturnable about the axis thereof.

DESCRIPTION OF THE PREFERRED EMBODIMENT

An embodiment of the present invention will be described hereinafter.

Figure 1:
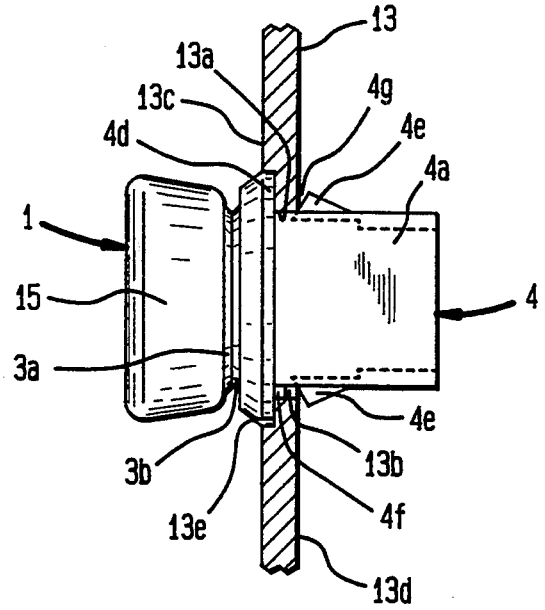
FIG. 1 is a side view showing a thread tension device as it is attached to a sewing machine body according to an embodiment of the present invention.
Figure 2:
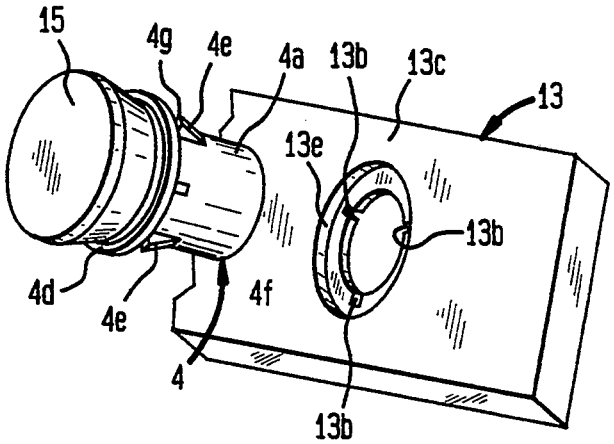
FIG. 2 is an exploded perspective view showing the thread tension device in FIG. 1.
Figure 3:
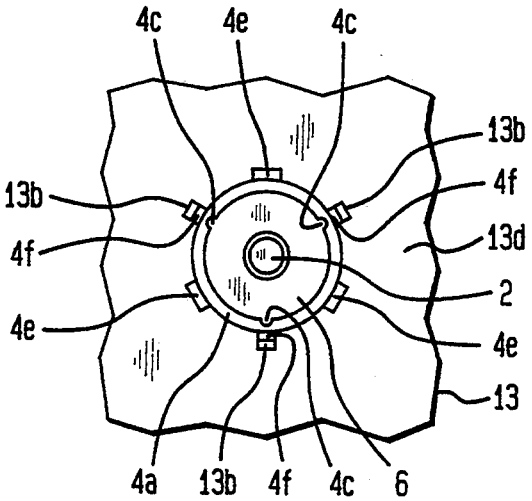
FIG. 3 is an rear view of the thread tension device in FIG. 1 as it is attached to the sewing machine body.
Figure 4:
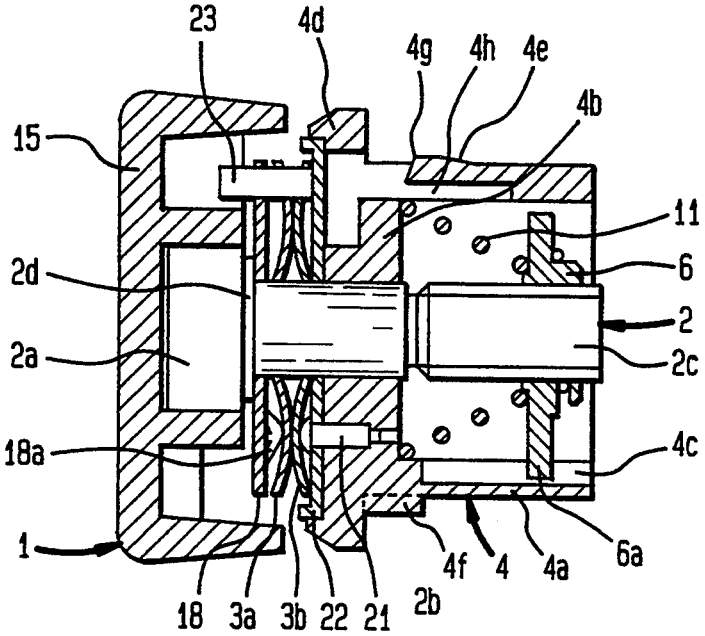
FIG. 4 is an enlarged cross-sectional view of the thread tension device in FIG. 1.
Figure 5:
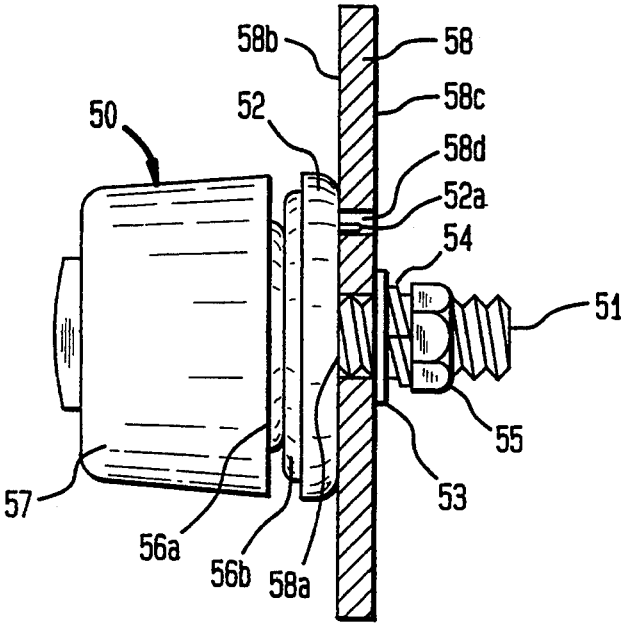
FIG. 5 is a side view showing a conventional prior art thread tension device as it is attached to a sewing machine body.

FIGS. 1 to 4 show an embodiment of the present invention. The outline of the thread tension device 1 for a sewing machine will be described with reference to FIG. 4 at first. A stem 2 is composed of a mounting portion 2*a* having a large diameter, a retaining portion 2*d* having a medium-sized diameter, a supporting portion 2*b* having a small diameter and an externally threaded portion 2*c*, which are arranged in this order from the base end portion of the stem 2. An annular plate 18, a pair of tension discs 3*a* and 3*b* and a thread tension device body 4 are successively fit onto the supporting portion 2*b* of the stem 2 and thereafter a regulating nut 6 is screwed onto the externally threaded portion 2*c* of the stem 2.

The thread tension device body 4 made of plastics is turnable relative to the stem 2. The annular plate 18 is retained by the annular side surface of the retaining portion 2*d* at a side surface thereof and is provided with a projecting portion 18*a* on the other side surface thereof. Since the projecting portion 18*a* contacts the tension disc 3*a*, it applies a comparatively large clamping force to a needle thread, not shown, passing round the supporting portion 2*b* of the stem 2 between the pair of tension discs 3*a* and 3*b*. The thread tension device body 4 comprises a cylindrical portion 4*a* and a flange portion 4*b* which internally projects therefrom at an end portion thereof. The thread tension device body 4 also comprises a metal supporting plate 22 on the outer surface of the internally projecting flange portion 4*b* fixed thereto by a pin 21, and a pin 23 projecting from the supporting plate 22 engages the pair of tension discs 3*a* and 3*b* and the supporting plate 18 at the notched portions thereof for preventing the same from turning.

A tension spring 11 for applying a clamping pressure to the thread is compressedly provided around the stem 2 between the inner surface of the internally projecting flange portion 4*b* of the thread tension device body 4 and the regulating nut 6. The regulating nut 6 engages the grooves 4*c* which axially extend on the inner surface of the thread tension device body 4 at the projections 6*a* on the outer circumferential edge thereof so as to be circumferentially properly positioned and unturnable about the axis relative to the thread tension device body 4. The thus assembled thread tension device 4 is attached to the sewing machine body 13 composed of the casing or front cover of the sewing machine.

A regulating dial 15 is attached to the mounting portion 2*a* of the stem 2 by way of serration combination so as to be unturnable relative to the latter. When the regulating dial 15 is turned normally or reversely together with the stem 2, the regulating nut 6 engaging the grooves 4*c* of the thread tension device body 4 at the projections 6*a* thereof so as to be unturnable relative to the thread tension device body 4 moves axially forward or backward thereby to change the amount of compression of the tension spring 11. As a result, the tension applied to the downstream portion of the thread relative to the pair of tension discs 3*a* and 3*b* can be adjusted according to the thickness of the thread by changing the amount of compression of the tension spring 11.

The structure of such a thread tension device 1 for attaching the same to the sewing machine body 13 will be described hereinafter. An annularly projecting portion 4*d* is formed on the outer circumference of the internally extending flange portion 4*b* of the thread tension device body 4 and pawls 4*e* are formed on a cylindrical portion 4*a* on the other side of the thread tension device body 4, being spaced from the projecting portion 4*d* at a given distance. The pawls 4*e* are formed in a cantilever shape on the cylindrical portion 4*a* of the thread tension device body 4 made of plastics integrally therewith so as to be gradually inclined outside from the roots thereof toward the projecting portion 4*d*. Each of the pawls 4*e* which projects from the outer circumference of the cylindrical portion 4*a* and confronts with the projecting portion 4*d* has an inclined surface 4*g* at the tip end thereof so as to form a radially expanding gap between the projecting portion 4*d* and itself. A plurality of such pawls 4*e* (3 pawls in the illustrated embodiment) which are connected to the cylindrical portion 4*a* at the base end portions thereof are arranged circumferentially at a proper interval on the cylindrical portion 4*a* and elastically invaginable thereinto. The pawls 4*e* are provided with notched portions 4*h* thereunder for allowing elastic deformation thereof.

Moreover, projections 4*f* are provided on the cylindrical portion 4*a* of the thread tension device 4 at the root of the projecting portion 4*d* disposed between circumferentially adjacent pawls.

On the other hand, the sewing machine body 13 is provided with an opening portion 13*a* thereon which fits with the cylindrical portion 4*a* of the thread tension device body 4 and has grooves 13*b* disposed on the opening portion 13*a* circumferentially at a proper interval for engaging the projections 4*f* of the thread tension device body 4. An annularly notched portion 13*e* is formed around the opening portion 13*a* on the outer side surface 13*c* of the sewing machine body 13 for receiving the annularly projecting portion 4*d* of the thread tension device body 4.

The operation of attaching such a thread tension device 1 to the sewing machine body 13 is performed as follows. That is, the thread tension device 4 is held at the regulating dial 15 and is inserted into the opening portion 13*a* of the sewing machine body 13 from the side of the outer side surface 13*c* thereof. When it is pushed in the opening portion 13*a*, each of the pawls 4*e* is elastically invaginated into the notched portion 4*h* of the thread tension device body 4, and when the projecting portion 4*d* contacts the outer side surface 13*c* of the sewing machine body 13, more exactly the annularly notched portion 13*e* thereof, the pawls 4*e* elastically rebound as they are released from the restriction of the opening portion 13*a*.

As a result, the thread tension device body 4 is fixedly attached to the sewing machine body 13 as the same is clamped between the projecting portion 4*d* of the thread tension device body 4, which contacts the outer side surface 13*c* of the sewing machine body 13, more exactly the annularly notched portion 13*e* thereof, and the pawls 4*e* of the thread tension device body 4 which are retained on the inner side surface 13*d* of the sewing machine body 13. The inclined surface 4*g* at each pawl 4*e* absorbs some difference in thickness between the annularly notched portion 13*e* and the inner side surface 13*d* of the sewing machine body 13 so as to clamp the same securely.

At that time, the projections 4*f* of the thread tension device body 4 engage the grooves 13*b* of the sewing machine body 13 so that the thread tension device body 4 is attached to the sewing machine body 13 so as to be properly positioned in the circumferential direction and unturnable about the axis thereof. If the cylindrical portion 4*a* of the thread tension device body 4 has a noncircular cross section and the opening portion 13*a* of the sewing machine body 13 has a shape which fits therewith, the thread tension device body 4 can be attached to the sewing machine body 13 so as to be unturnable relative to the latter without projections 4*f* thereon.

When the thread tension device 1 is detached from the sewing machine body 13, the operator draws out the thread tension device body 4 toward the side of the outer side surface 13*c* of the sewing machine body 13 while pushing the pawls 4*e* to elastically invaginate the same into the thread tension device body 4 with his hand inserted into the sewing machine body 13 from the side of the inner side surface 13*d* thereof.

As evident from the above description, since the thread tension device can be attached to or detached from the sewing machine body in one-shot operation according to the present invention, the operability is remarkably improved in efficiency.

What is claimed is:

1. In combination with a sewing machine body having an opening in which a thread tension device is mounted, said opening having two opposite sides and having spaced apart slots disposed in its periphery, said device comprising:

a circular dial;

a retaining first plate secured to the dial;

a stem secured at one end to said plate and extending outwardly from the center of the plate at right angles thereto and extending through the opening;

a second plate parallel to the first plate and disposed adjacent thereto, the second plate having an opening through which the stem extends and an offset opening;

first and second interconnected tension discs having aligned central openings through which the stem extends, the discs being disposed with the first disc adjacent the second plate, the discs having aligned offset openings;

a horizontal conically shaped projection prong having a base secured at right angles to the second plate, the prong having an apex engaging the first disc;

a third plate parallel to the second plate and having an opening through which the stem extends, said dial, securing plate, second plate, prong, discs and third plate being disposed on one side of the opening, the third plate having projections which engage said one side of the opening, portions of said projections engaging the peripheral slots to prevent rotation of the device in the machine body opening;

a horizontal member secured at one end to the third plate offset from its central opening and extending through the offset openings of the discs and first and second plates to prevent rotation thereof; and thread tension device body disposed on the other side of the opening, said body including a hollow cylindrical portion surrounding the stem and means securing the portion to the stem, said portion having an open end adjacent the opening, said open end having spaced apart pawls which engage the other side of the opening, the pawls and projections clamping the machine body therebeween.

* * * * *